US010473425B2

(12) United States Patent
Gorton

(10) Patent No.: US 10,473,425 B2
(45) Date of Patent: Nov. 12, 2019

(54) LONG GUN MOUNTING DEVICE

(71) Applicant: Stuart Albert Gorton, Longmont, CO (US)

(72) Inventor: Stuart Albert Gorton, Longmont, CO (US)

( * ) Notice: Subject to any disclaimer, the term of this patent is extended or adjusted under 35 U.S.C. 154(b) by 31 days.

(21) Appl. No.: 15/926,994

(22) Filed: Mar. 20, 2018

(65) Prior Publication Data

US 2019/0293385 A1 Sep. 26, 2019

(51) Int. Cl.
*F41C 33/00* (2006.01)
*A45F 3/08* (2006.01)

(52) U.S. Cl.
CPC ..... *F41C 33/005* (2013.01); *A45F 3/08* (2013.01)

(58) Field of Classification Search
CPC ..... A47B 81/005; F41A 23/18; F41A 23/26; F41C 33/005; F41C 33/06; F41C 33/046; F41C 33/003; A45F 3/14
See application file for complete search history.

(56) References Cited

U.S. PATENT DOCUMENTS 4,057,180 A * 11/1977 Whittaker ..... B60R 7/14 224/282
5,975,389 A * 11/1999 Braun ..... A01M 31/02 182/187
7,467,719 B2 * 12/2008 Crowell ..... F41A 23/18 211/4
8,678,206 B2 * 3/2014 Kubiniec ..... A47B 81/005 211/64
9,194,655 B1 * 11/2015 Cha ..... A45F 3/14
9,884,593 B2 * 2/2018 Hull ..... B60R 7/14
2007/0145091 A1 * 6/2007 Meesey ..... A45F 3/08 224/649
2010/0012691 A1 * 1/2010 Hyle ..... F41C 33/005 224/149
2018/0289135 A1 * 10/2018 Bezem ..... A45F 4/02

* cited by examiner

*Primary Examiner* — Corey N Skurdal

(57) ABSTRACT

A mounting device attachable on a backpack or the like is described that allows a backpack wearer to remove a long gun from the backpack and reattach it without removing the backpack, and without assistance from a second person. The mounting device includes a generally rigid base member with a generally rigid first member pivotally attached to a first end, wherein the first member includes a horizontal surface for receiving a long gun butt and a means for securing the butt to it. A second member, defined as a grasping mechanism, is attached to a second end of the base member and receives a long gun barrel or barrel and forend. A coupling means is also included that allows the mounting device to be attached to a multiplicity of backpack types.

19 Claims, 9 Drawing Sheets

LONG GUN MOUNTING DEVICE

CROSS REFERENCE TO RELATED APPLICATIONS

This is a non-provisional application based upon U.S. provisional patent application Ser. No. 62/479,224, entitled "Long Gun Mounting Device", filed Mar. 30, 2017, which is incorporated herein by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to a device that allows a long gun to be mounted on a backpack and more particularly allows the wearer of the backpack to access the long gun without the need of removing the pack. While in the act of hunting it is often desirable for the hunter to wear a backpack in which to store such things as food, water, extra clothing, ammunition and the like. It is also often desirable for the hunter to have their hands free in order to negotiate rough or brushy terrain, manipulate trekking poles, or operate binoculars. In the past the hunter might utilize a gun sling to suspend the long gun from one of their shoulders, while also wearing a separate backpack. While the hunter is immobile a gun sling is generally effective at maintaining the long gun in a hands free manner. While in motion however, one of the hunter's hands must be used to prevent the long gun from swinging around and from sliding off the hunter's shoulder.

In an attempt to mitigate this, there have been many varied examples in the prior art of means and mechanisms that allow a long gun to be affixed to a backpack, and thus free the hands of the backpack wearer. These generally fall into one of three categories concerning the access the wearer of the backpack has to a long gun, unaided by a second person.

In the first of these categories, the wearer of a backpack is required to remove the pack to either remove the long gun from it, or reattach the long gun to it. Such a mechanism is disclosed in U.S. Pat. No. 4,754,904 by Fischer, and again in U.S. Pat. No. 6,290,114 by Berberian. While this latter art specifies that its use is for a hunting bow, it is obvious that it could be adapted for use with a long gun. Whether used to transport a hunting bow or long gun, the wearer of either of these backpacks is required to remove the pack in order to manipulate straps and buckles that secure the hunting implement to the pack. This action results in considerable movement by the wearer that can alarm game, and consumes time that a hunter rarely has in abundance.

In the second category of prior art, the wearer of a backpack can remove a long gun from the pack without removing the pack itself, but due to a plurality of straps and fasteners, must remove the pack to reattach the long gun to it. This is the case for U.S. Pat. No. 995,458 disclosed by Harriman, U.S. Pat. No. 7,735,701 disclosed by Eberle, U.S. Pat. No. 9,074,840 disclosed by Andersen, as well as U.S. Pat. No. 9,194,655 disclosed by Cha. While devices within this second category allow a hunter to more quickly and conveniently remove a long gun than those devices within the first category, the hunter is forced to take off their backpack after every encounter with game in order to reattach the long gun to the pack.

The third category of prior art includes those concepts that could conceivably allow a backpack wearer to remove a long gun from the backpack, and reattach it, without the need of removing the pack itself. One concept within this category utilizes a gun scabbard that is attached to a backpack and was disclosed by Eberle in U.S. Pat. No. 6,763,987, and again in U.S. Pat. Nos. 7,654,426 and 8,397,965. In order to remove the long gun from the scabbard though, the wearer is required to grasp and manipulate the long gun above and behind their shoulder, a combination beyond the physical range of motion of many people, and one that is made more difficult if the hunter is wearing bulky cold weather clothing. The reinsertion of the long gun into the scabbard also requires that the wearer have a firm sense of the placement of the scabbard relative to their body, as the wearer has a limited view of the scabbard. An additional problem associated with this concept it that a substantial portion of the long gun extends above the head of the wearer, making it difficult to conveniently and quietly traverse the thick cover in which game typically resides.

Another concept that potentially fits within the third category of prior art was disclosed in U.S. Patent Application Publication No. 2010/0012691 by Hyle. In this concept the barrel of the long gun is threaded through a circular shaped opening near the top of the backpack frame, and the butt is placed in a cup like enclosure attached to the bottom of the backpack frame. While the butt of the long gun can be secured within the butt shaped cup, the circular opening allows the barrel to move relative to the backpack, creating an unwanted source of noise and instability. This problem is further exacerbated if the diameter of the circular opening is sized to accommodate a long gun that has an open sight affixed to the end of the barrel, as is often the case. Another disadvantage of this concept is that the long gun is situated such that its placement conflicts with the free movement of the adjacent arm of the hunter.

What is needed then is a device that fits within the third category that allows the wearer of a backpack to remove a long gun from the pack and reattach it to the pack in a manner that does not cause physical discomfort, and that maintains the long gun in a position that is substantially behind the head and body of the wearer, where it is protected from brush. Additionally, it would be desirable for such a device to rigidly retain the long gun to the backpack, reducing instability and resultant noise.

SUMMARY OF THE INVENTION

The present invention contemplates a new long gun mounting device that greatly improves the access a hunter has to a long gun, or similarly shaped object, that is carried on the hunter's backpack.

According to the present invention, the mounting device includes a generally rigid first member that is attached to one end of a generally rigid base member. In addition to having a horizontal surface for receiving the butt of a long gun, the first member also includes a means for securing the long gun butt to the first member. Attached to the opposite end of the base member is a grasping mechanism that receives the barrel or barrel and forend of the long gun.

In one embodiment of the present invention, the distance between the horizontal surface of the first member and the grasping mechanism is adjustable.

In another embodiment of the invention, the first member is pivotally attached to the base member.

In another embodiment, the invention features a grasping mechanism control handle that is mechanically or wirelessly connected to the grasping mechanism.

In another embodiment, the grasping mechanism control handle includes a releasable locking device.

In another embodiment of the invention, the area of the opening associated with the grasping mechanism is adjustable.

In another embodiment, the invention features a means of attaching the mounting device to a backpack.

A principal advantage of the invention resides in the ability of the wearer of a long gun mounting device equipped backpack to remove a long gun, or other similarly shaped elongated object, from the pack and reattach it to the pack without the need of removing the pack itself, without the need of uncomfortably reaching above and behind one's shoulder, or without the assistance of a second person.

Another advantage of the invention is found in the ability of the mounting device to be attached to a wide variety of backpack types and sizes.

Another advantage of the invention lies in the adjustability of the mounting device, allowing it to accommodate a wide variety of long gun types and sizes.

Another advantage of the invention resides in the rigid and secure manner in which the long gun is mounted to a backpack, and thus to the wearer of the backpack.

Another advantage of the invention is found in the placement of the mounting device and long gun substantially behind the head and body of the backpack wearer.

Still other advantages and benefits of the invention will become apparent to those skilled in the art upon a reading and understanding of the following detailed description and associated drawing figures.

DESCRIPTION OF THE VIEWS OF THE DRAWINGS

A fuller understanding of the nature and objects of the present invention will become apparent upon consideration of the following detailed description, taken in connection with the accompanying drawings, wherein.

DETAILED DESCRIPTION OF THE PREFERRED EMBODIMENTS

Figure 1:
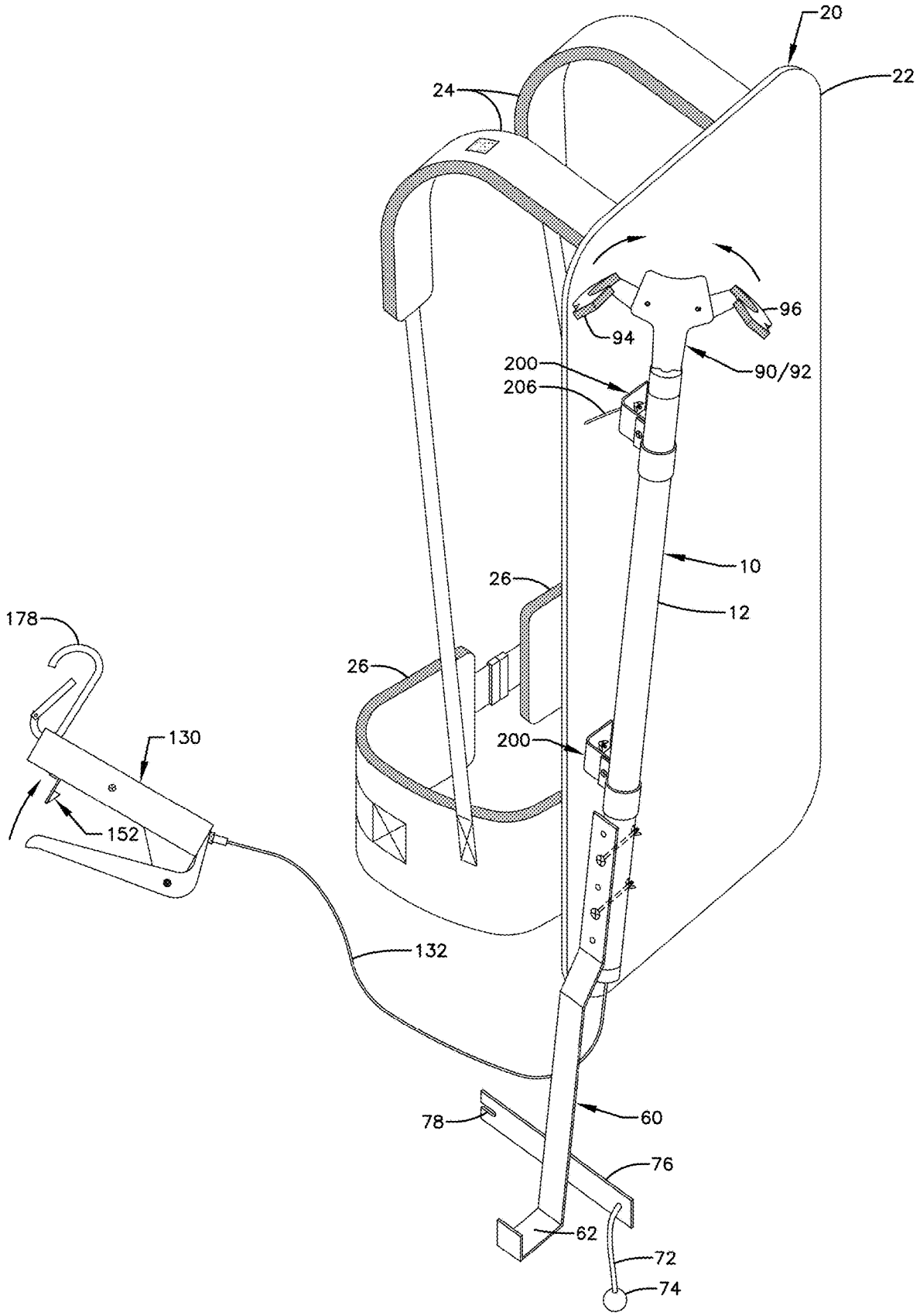
FIG. 1 is a perspective view of the long gun mounting device, showing the invention in an open or relaxed position and attached to a simple backpack.
Figure 2:
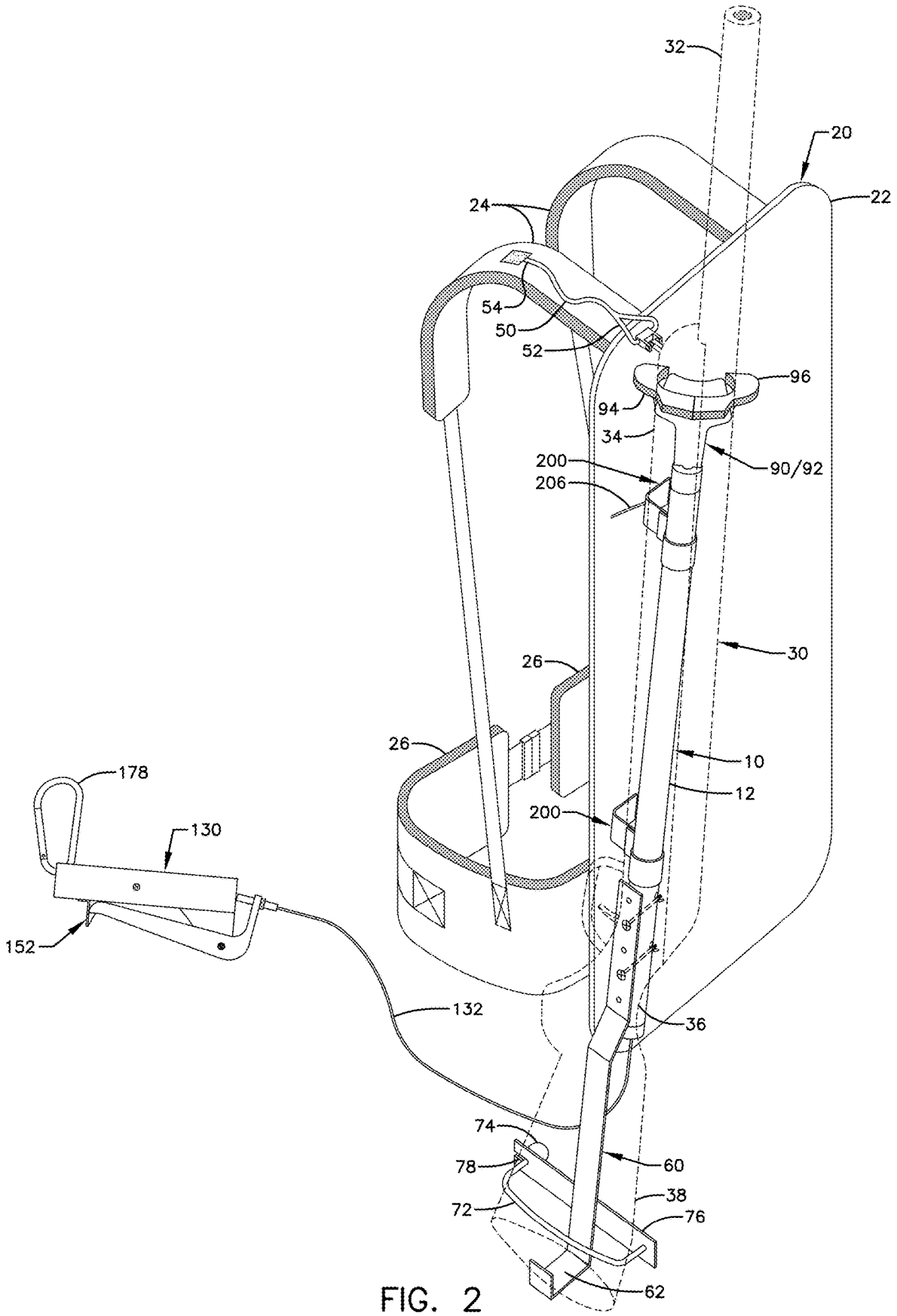
FIG. 2 is a perspective view of the mounting device of FIG. 1 in a closed or engaged position and securing a long gun.

Referring now to the drawings, in FIG. 1 there is shown a long gun mounting device 10 embodying the present invention attached to a simple version of a backpack 20. As hereinafter described, mounting device 10 is movable between an open or relaxed position, and a closed or engaged position. The relaxed position is shown in FIG. 1 and the engaged position is shown in FIG. 2, the latter in which mounting device 10 is also shown securing a long gun 30.

Long gun mounting device 10 includes an elongated base member 12, preferably consisting of a tube, with a first member 60 attached to one end and a second member 90 attached to the other end. A pair of coupling brackets 200 are provided for attaching mounting device 10 to backpack 20 which includes a frame 22, shoulder straps 24, a waist belt 26, and a bag for carrying sundry items (bag not shown).

Figure 3A:
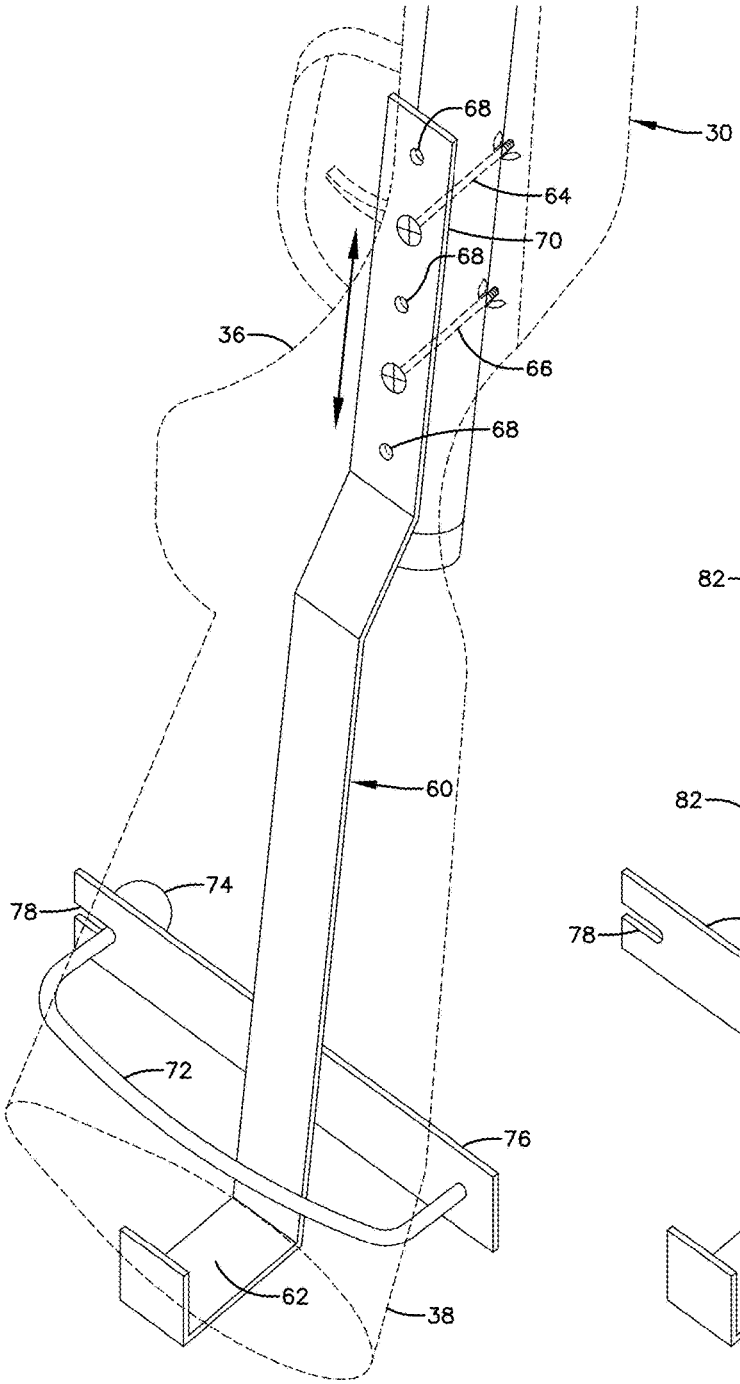
FIG. 3A is a perspective view of the first member with a long gun butt secured, and a means of attaching it to the base member.

Referring now to FIG. 3A, first member 60 can be attached to base member 12 by way of a base bolts 64 and 66, and includes a horizontal surface 62 that receives a butt 38 of long gun 30. A plurality of base bolt holes 68 in a mating surface 70 can allow the adjustment of first member 60 and horizontal surface 62, relative to base member 12 and second member 90, thusly allowing a user to adjust the length of mounting device 10 to accommodate various long gun sizes and types (direction arrows in FIG. 3A indicate length adjustment direction). In order to secure butt 38 to first member 60, first member 60 can also include a horizontal member 76 having an elastic member 72 fixed to one end. To a free end of elastic member 72 a stop 74 can be fixed that can be engaged in a stop slit 78 on the opposite end of horizontal member 76.

Figure 3B:
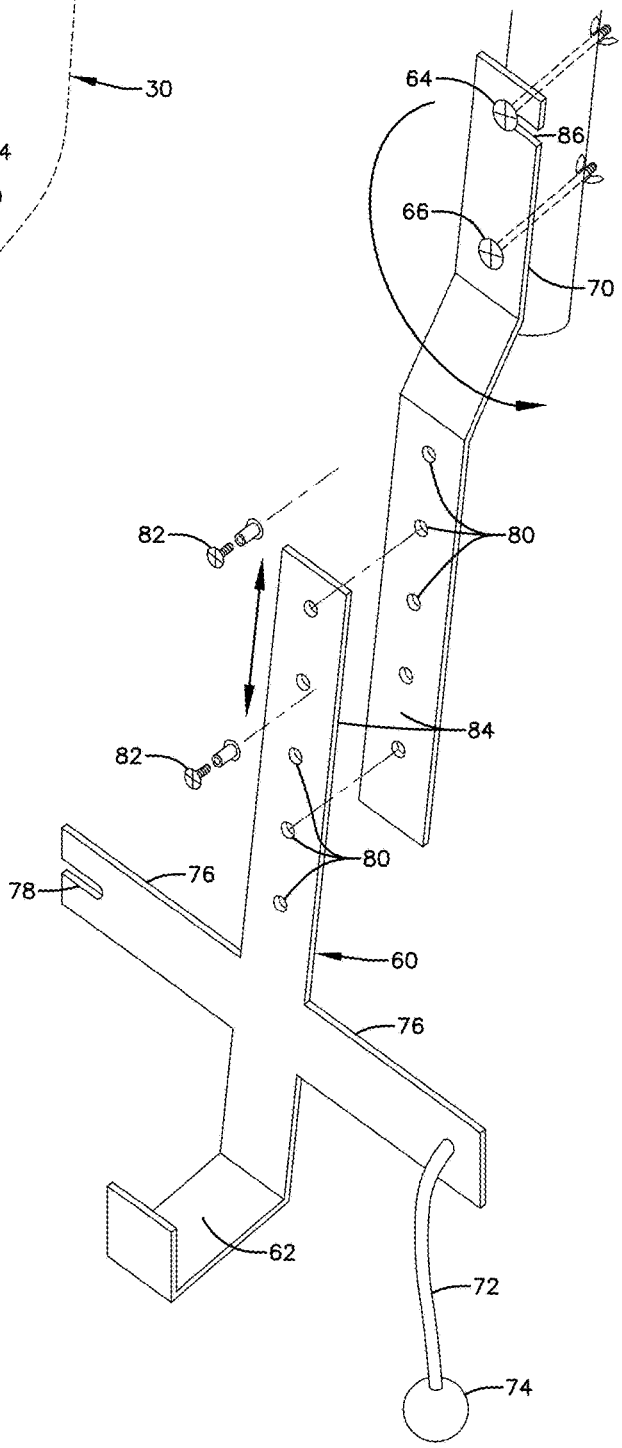
FIG. 3B is a perspective view of an alternative embodiment of the first member of FIG. 3A and an alternative means of pivotally attaching it to the base member.

Another embodiment of first member 60 is shown in FIG. 3B. In this representation, the adjustment of horizontal surface 62 relative to base member 12 and second member 90 can be realized by way of a plurality of binder holes 80 in adjustable surfaces 84, with binder screws 82 joining adjustable surfaces 84 (direction arrows in FIG. 3B indicate length adjustment direction). A swivel slit 86 in mating surface 70 allows first member 60 to pivot about base bolt 66, without the need of removing base bolt 64. In this embodiment, first member 60 can quickly be rotated up and out of the way when not in use, allowing a backpack wearer to more easily sit without removing backpack 20, or allowing backpack 20 to sit vertically upright when not in use (a direction arrow in FIG. 3B indicates direction of first member 60 rotation).

Second member 90, which receives the barrel 32 or barrel 32 and forend 34 of long gun 30, is defined as a grasping mechanism 92, as it performs much the same function as a human hand grasping an object. While there exists a wide variety of employable grasping mechanisms, created for a multiplicity of uses, a preferred embodiment of the present invention utilizes a grasping mechanism 92 commonly used to pick up litter or to reach objects located on a high shelf. These types of devices are commonly referred to as a grabber arm, reach extender, helping hand, or a Nifty Nabber. In one embodiment of the invention (not shown), another grasping mechanism, mechanically coordinated with grasping mechanism 92 of second member 90, is used as butt 38 securing means.

Figure 4A:
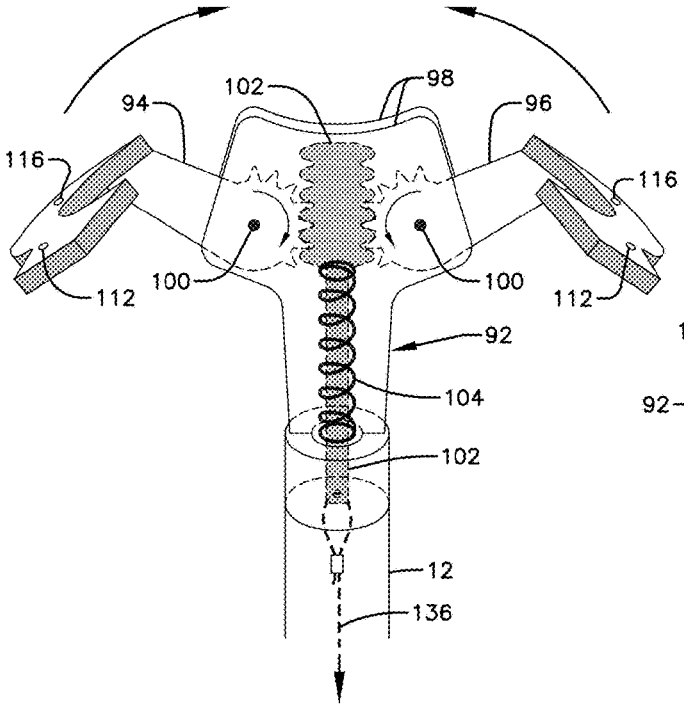
FIG. 4A is a perspective view of a preferred embodiment of the grasping mechanism.

Referring now to FIG. 4A, grasping mechanism 92 can include pinioned grasping arms 94 and 96, that are contained within housing plates 98, and rotate about arm pivots 100. The rotational movement of grasping arms 94 and 96 is governed by the linear up and down movement of a vertical rack 102, which in turn is governed by the movement of an inner cable 136 (discussed later) that is attached to the lower extremity of vertical rack 102. A spring 104, which encircles the lower portion of vertical rack 102, seeks to maintain grasping mechanism 92 in an open or relaxed position, the position depicted in FIG. 4A. Like grasping arms 94 and 96, vertical rack 102 and spring 104 are contained within housing plates 98. Direction arrows shown in FIG. 4A indicate the linear direction of travel of inner cable 136 and vertical rack 102, as well as the resultant direction of rotation of grasping arms 94 and 96 required to manipulate grasping mechanism 92 to the closed or engaged position.

Figure 4B:
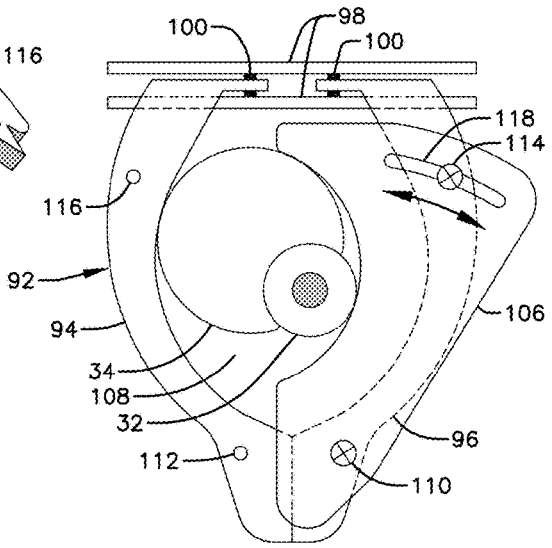
FIG. 4B is a plan view of the grasping mechanism with an opening adjustment plate adjusted to accommodate a long gun barrel and forend.

In order to accommodate a wide variety of long gun types, or unrelated items such as trekking poles, fishing rods, or the like, one embodiment of the invention provides an opening adjustment plate 106 that can be pivotally attached to either grasping arm 94 or grasping arm 96, and allows for the narrowing or widening of a grasping mechanism opening 108 (FIG. 4B). Opening adjustment plate 106 pivots about a front bolt 110 that is situated in a front arm hole 112 in grasping arm 96, while a rear bolt 114, situated in a rear arm hole 116, floats within a plate slit 118 in opening adjustment plate 106 (direction arrows in FIG. 4B indicates direction of opening adjustment plate 106 rotation). Once grasping mechanism opening 108 has been sized for a particular long gun 30 or portion of it (the barrel of a rifle, the barrel and forend of a rifle, the barrel of a shotgun, or the barrels of a double barreled shotgun), front bolt 110 and rear bolt 114 are tightened to secure opening adjustment plate 106 to grasping arm 96.

Figure 6A:
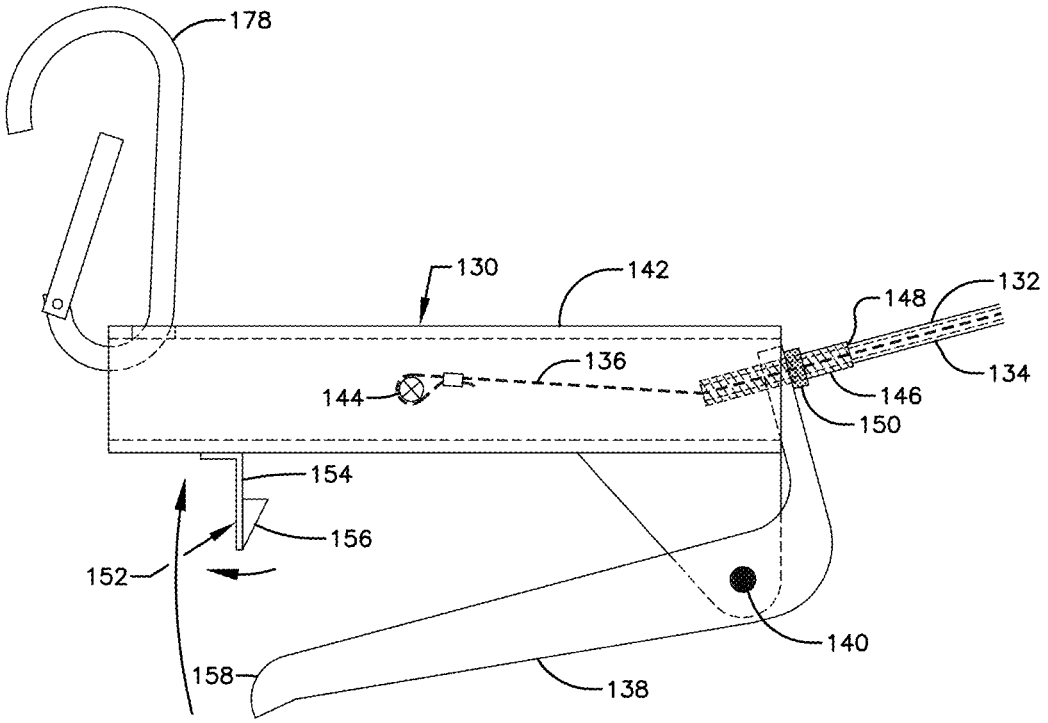
FIG. 6A is a side view of one embodiment of the grasping mechanism control handle in an open or relaxed position.
Figure 6B:
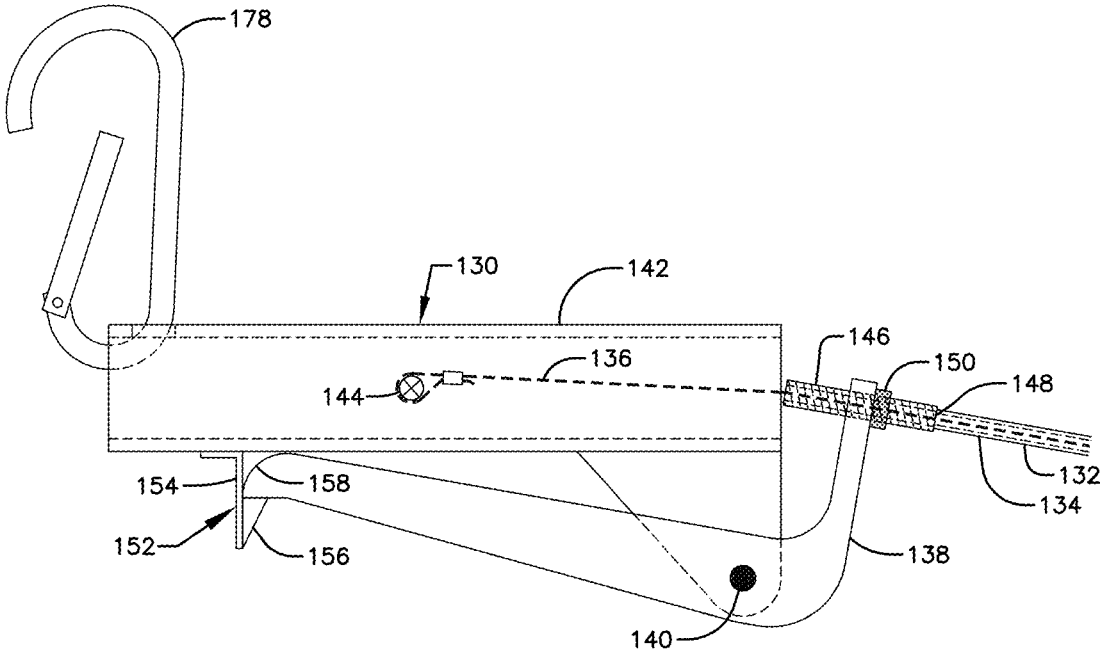
FIG. 6B is a side view of the control handle of FIG. 6A in a closed or engaged position and locked in that position by way of one embodiment of a releasable locking device.

According to one embodiment of long gun mounting device 10, grasping mechanism 92 is wirelessly manipulated from a conveniently placed remote control (not shown). However in the present embodiment, grasping mechanism 92 is mechanically connected to a grasping mechanism control handle 130. One embodiment of handle 130 is shown in FIG. 6A, which shows handle 130 in an open or relaxed position, while FIG. 6B shows handle 130 in a closed or engaged position. In this embodiment the mechanical connection between grasping mechanism 92 and handle 130 is made by way of a flexible bowden cable 132, commonly used in bicycle braking systems, that includes an outer sheath 134 and an inner cable 136. Handle 130 includes a handle lever 138 that rotates about a handle pivot 140 in a handle base 142. On the handle 130 end of bowden cable 132, outer sheath 134 terminates at an outside edge 148 of a threaded hollow tube 146 that passes through handle lever 138, while inner cable 136 passes through threaded hollow tube 146 and into handle base 142, where it terminates at a handle bolt 144. The tension of inner cable 136 can be adjusted by manipulating an adjustment nut 150 on threaded hollow tube 146. In an alternative embodiment (not shown), handle pivot 140 is on the opposite end of handle base 142 from bowden cable 132, provided a variation in grip direction.

The embodiment depicted in FIGS. 6A and 6B also makes use of a spring lock 152 that further comprises a flexible member 154 that is fixed to handle base 142, and a lock wedge 156 that is fixed to flexible member 154. When handle 130 is manipulated from the relaxed to engaged position, a curved surface 158 on handle lever 138 engages lock wedge 156, pushing lock wedge 156 and flexible member 154 to the side. Once curved surface 158 clears lock wedge 156, lock wedge 156 maintains handle lever 138 in the engaged position (direction arrows in FIG. 6A indicate the direction of rotation required to manipulate handle lever 138 and spring lock 152 to the closed or engaged position).

In another embodiment, grasping mechanism control handle 130 makes use of a bike brake handle 160 (see FIGS. 6C and 6D), that like bowden cable 132 is commonly used in bicycle braking systems. Since bike brake handle 160 operates mechanically the same as handle 130, bike brake handle 160 also includes similar components. In this embodiment a brake handle lever 162 rotates about a brake handle pivot 164 in a brake handle base 166. While bowden cable 132, threaded hollow tube 146 and adjustment nut 150 are the same, and perform the same function as handle 130 of FIGS. 6A and 6B, in this embodiment inner cable 136 terminates on brake handle lever 162 directly instead of handle bolt 144.

Figure 6C:
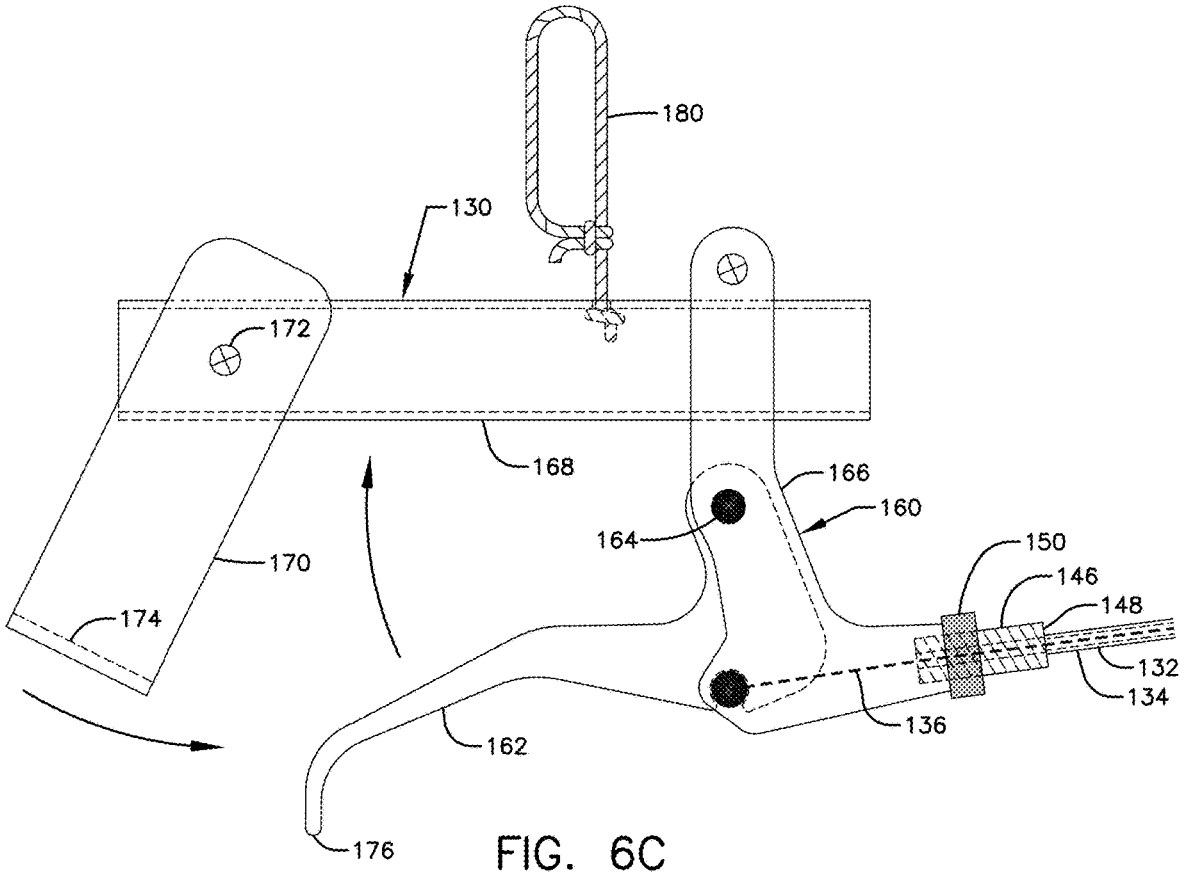
FIG. 6C is a side view of an alternative embodiment of the grasping mechanism control handle in an open or relaxed position.
Figure 6D:
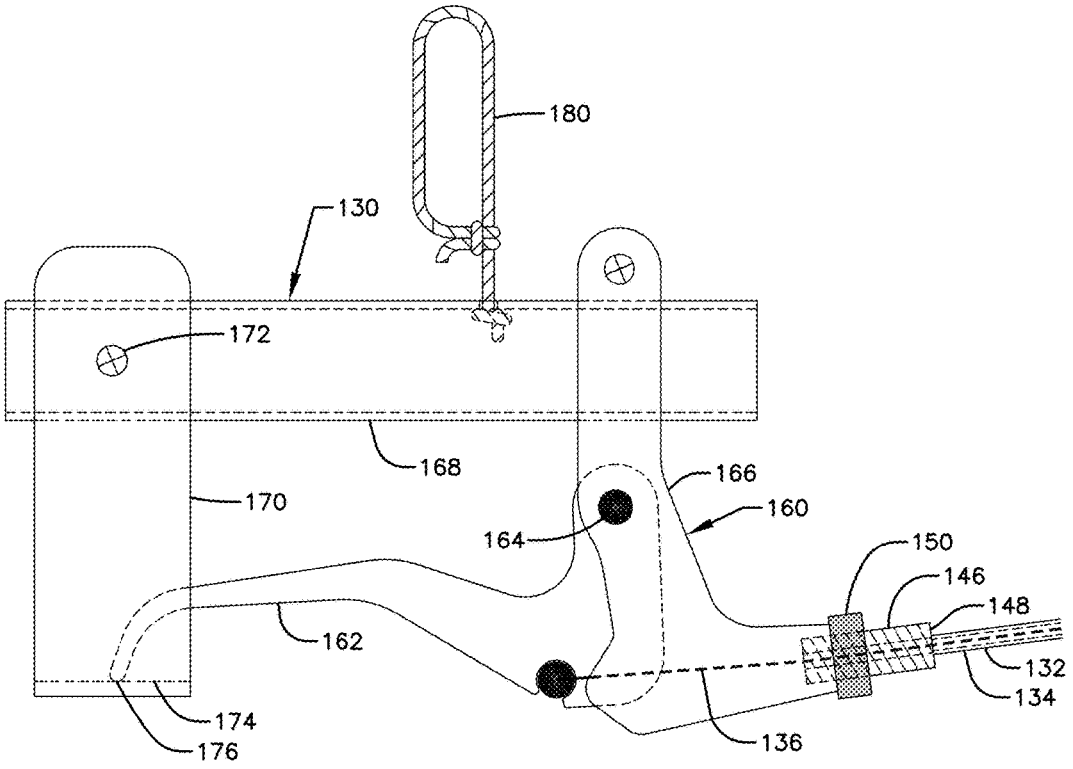
FIG. 6D is a side view of the control handle of FIG. 6C in a closed or engaged position and locked in that position by way of an alternative embodiment of a releasable locking device.

In the embodiment depicted in FIGS. 6C and 6D, brake handle base 166 is attached to a brake handle tube 168. Pivotally attached to brake handle tube 168 by way of a gate bolt 172 is a U-shaped gate 170. When brake handle lever 162 is manipulated to the closed or engaged position, gate 170 can then be rotated about gate bolt 172 until a gate surface 174 contacts and retains a lever tip 176 (direction arrows in FIG. 6C indicate the direction of rotation required to manipulate brake handle lever 162 and gate 170 to the closed or engaged position). In another embodiment, a locking bicycle brake handle can be used (not shown) that includes an integrated locking device, negating the need for a separate locking device.

As previously stated, one embodiment of the present invention utilizes a second grasping mechanism to secure butt 38 instead of elastic member 72 (not shown). In order to mechanically coordinate two grasping mechanisms, a commercially available dual pull brake lever can be used that accepts two bowden cable inputs (also not shown).

Regardless of the type of grasping mechanism control handle 130 that is used, a user might find it convenient to attach handle 130 to shoulder straps 24 or waist belt 26 of backpack 20. While this can be accomplished in a multitude of ways, one embodiment makes use of a carabiner 178 to facilitate the connection (as is depicted in FIGS. 1, 2, 6A and 6B), while another utilizes a looped cord 180, through which waist belt 26 can be threaded (as is depicted in FIGS. 6C and 6D).

Figure 5A:
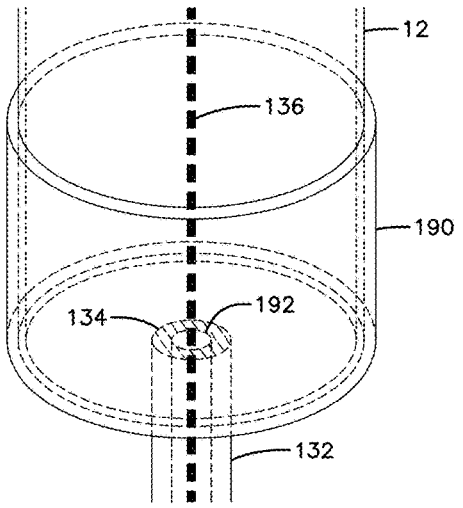
FIG. 5A is a close-up perspective view of a means of terminating the outer sheath of a bowden cable at one end of the base member.
Figure 5B:
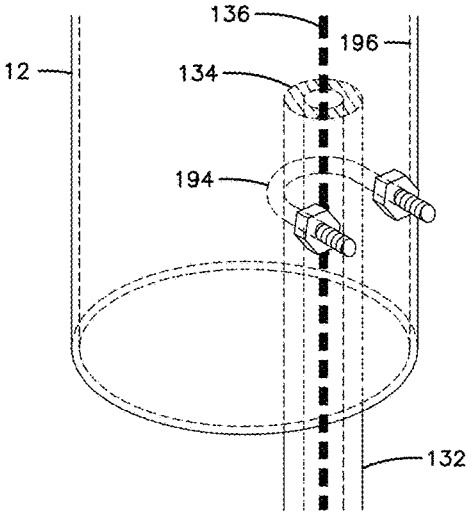
FIG. 5B is a close-up perspective view of an alternative means of terminating the outer sheath of a bowden cable at one end of the base member.

For those embodiments in which bowden cable 132 is utilized, the curvilinear movement of inner cable 136 ultimately dictates the rotational movement of grasping arms 94 and 96. In order for this to function, outer sheath 134 must be restrained on either end. As previously stated, on handle 130 end of mounting device 10, outer sheath 134 is restrained by outside edge 148 of threaded hollow tube 146. Referring now to FIG. 5A, one embodiment for securing the opposing end of outer sheath 134 is set forth. In this embodiment an end cap 190 is attached to first member 60 end of base member 12. While a cap hole 192 in end cap 190 is large enough to allow inner cable 136 to pass through, it is too small to allow the passage of outer sheath 134, thusly restraining it. Another embodiment for restraining first member 60 end of outer sheath 134 is shown in FIG. 5B. In this embodiment, a U-bolt 194 applies clamping pressure to restrain outer sheath 134 to an inner surface 196 of first member 60.

Figure 7A:
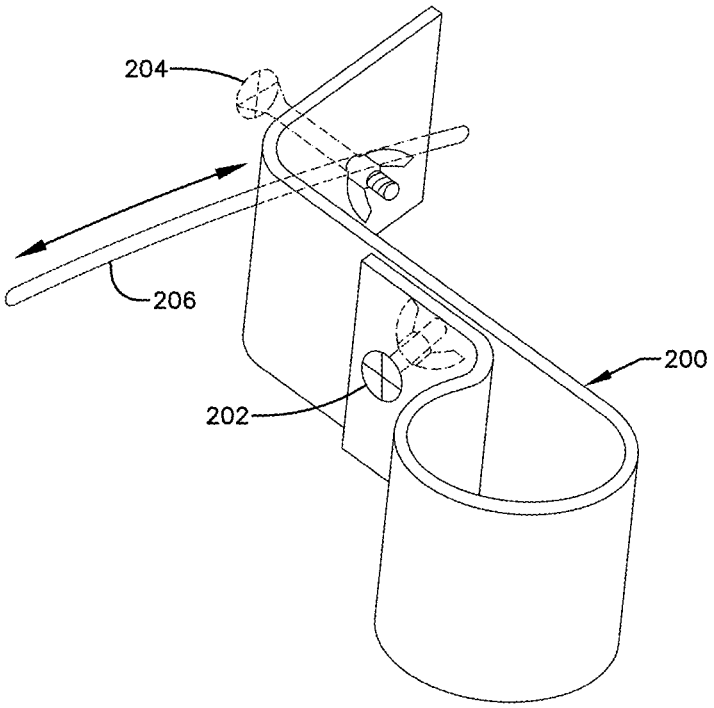
FIG. 7A is a perspective view of an embodiment of a coupling bracket.

In FIG. 7A there is shown an embodiment for attaching long gun mounting device 10 to a simple backpack frame 22. In this embodiment, coupling bracket 200 grips base member 12 with clamping force being applied by a coupling bolt 202. Similarly, a frame bolt 204 applies clamping force to secure coupling bracket 200 to frame 22. A frame slit 206 in frame 22 allows coupling bracket 200 to be adjusted left or right relative to frame 22 to suit the preference of a particular backpack wearer.

Figure 7B:
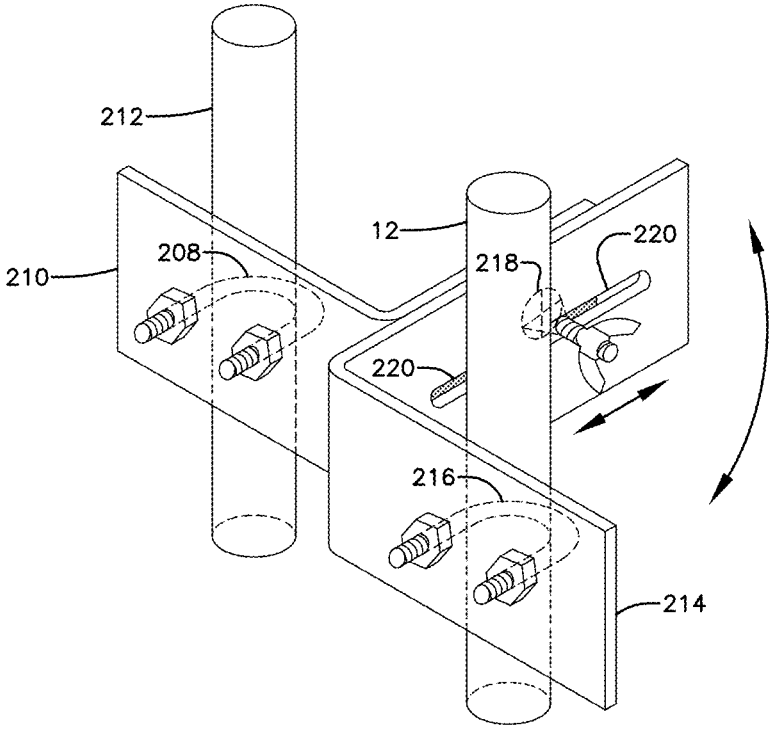
FIG. 7B is a perspective view of an alternative embodiment of a coupling bracket; and, FIG. 8A though FIG. 8H are profile views depicting the preferred method by which a backpack wearer removes a long gun from, and secures a long gun to, the long gun mounting device.

In many instances it would be convenient to attach long gun mounting device 10 to an external frame backpack, the details of which are set forth in U.S. Pat. No. 6,179,188 by Gleason, the disclosure of which is incorporated by reference. A way of coupling mounting device 10 to this type of backpack is illustrated in FIG. 7B, where a frame U-bolt 208 secures a frame bracket 210 to an external frame 212, which is defined as being either a "side rail" or "crossbar" as identified in the Gleason art. Similarly, base member 12 is secured to a base bracket 214 by way of a base U-bolt 216. Base bracket 214 and frame bracket 210 are then secured to each other with clamping force applied by a base bracket bolt 218. Additionally, base bracket 214 also comprises a base bracket slit 220 in which base bracket bolt 218 can travel when loose, allowing a wide range of possible configurations between frame bracket 210 and base bracket 214. In yet another embodiment, commercially available webbing or straps can be used to attach long gun mounting device 10 to backpack 20, or more typically to a bag attached to backpack 20 (this latter embodiment is not shown).

While it is preferable for backpack 20 to be rugged in construction, it is also advantageous for it to be light in weight as well. In order to satisfy these competing goals, the preferred embodiment of long gun mounting device 10 can use lightweight, yet rugged materials such as aluminum, fiberglass composite, carbon fiber composite, or the like in its construction. Components of mounting device 10 that can make contact with long gun 30 or vegetation, such as first member 60 and second member 90, can be covered in a noise reducing material such as rubberized paint or an adhesive backed foam or felt tape.

Another feature of the present invention as yet undisclosed includes a leash 50 (as shown in FIG. 2 and FIGS. 8A through 8H), which can consist of flexible rope, cordage, or the like. A first leash end 52 can attach to barrel 32 or forend 34 of long gun 30, while a second leash end 54 can attach to shoulder straps 24 of backpack 20, or other convenient location, by way of a hook and loop fastener, snap fastener, or the like. The use of leash 50, as well as other features previously disclosed, are then forthcoming.

Figure 8A:
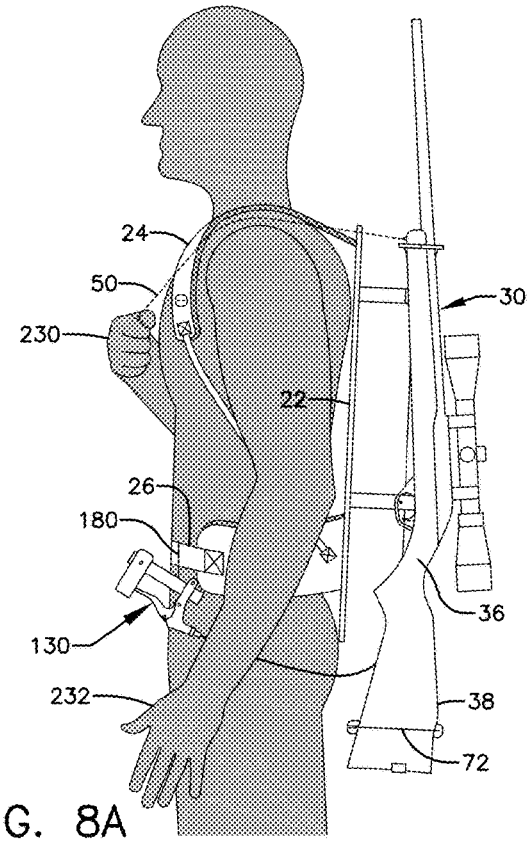
Figure 8B:
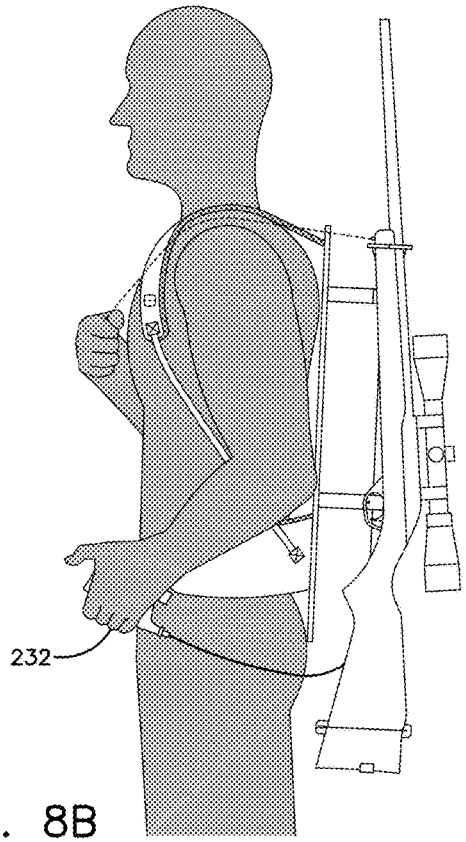
Figure 8C:
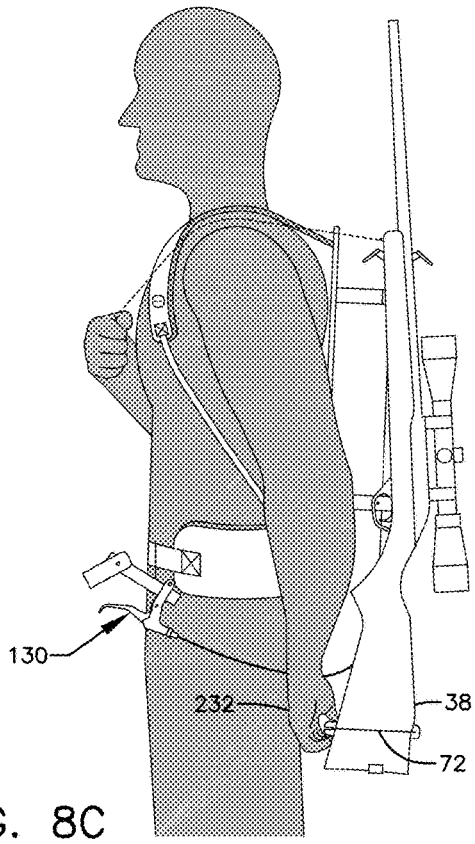
Figure 8D:
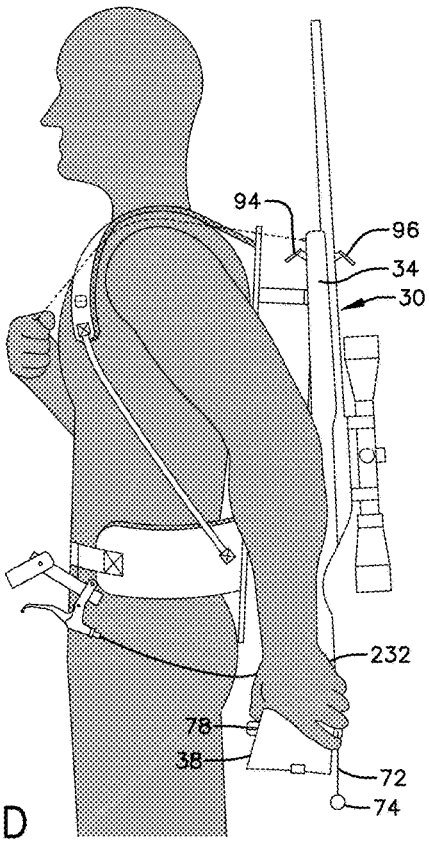
Figure 8E:
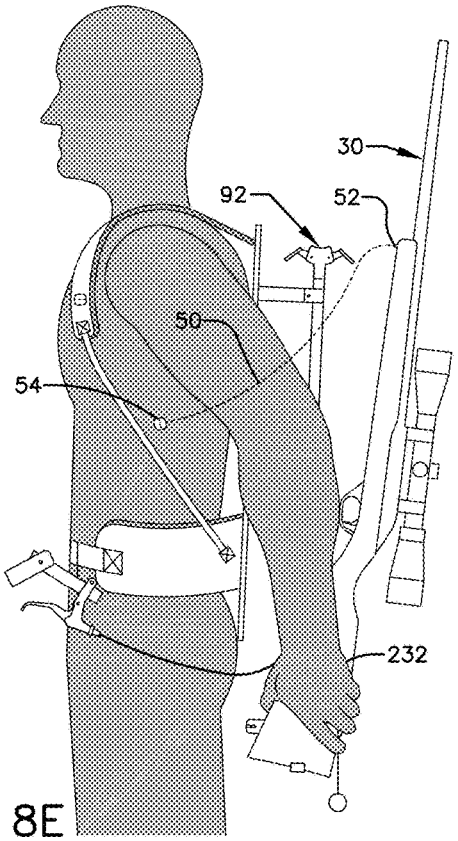
Figure 8F:
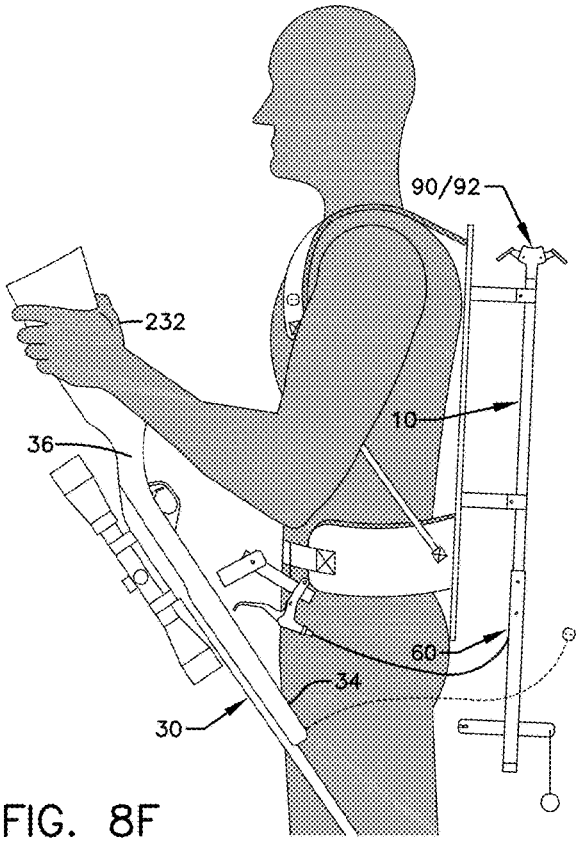
Figure 8G:
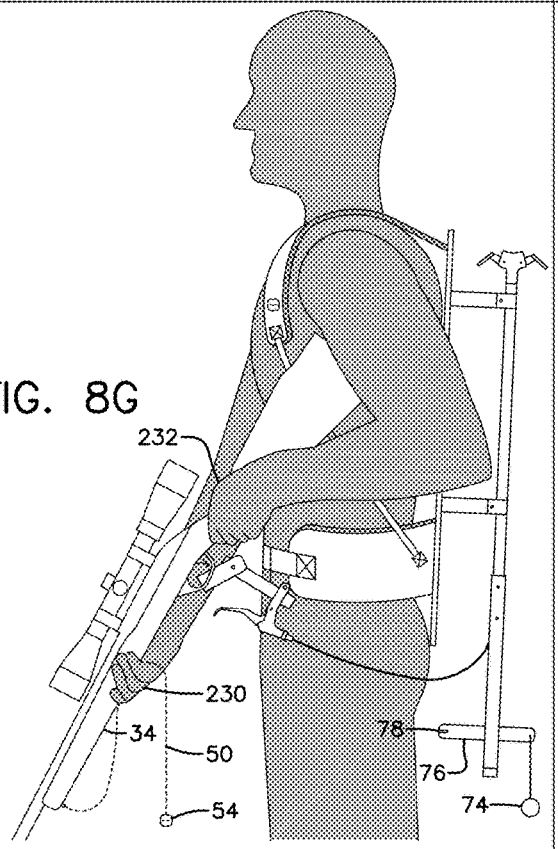

The preferred method by which long gun 30 is removed from the preferred embodiment of long gun mounting device 10 is depicted in FIGS. 8A through 8H. Beginning with FIG. 8A, a right hand 230 grasps second leash end 54. This is followed by a left hand 232 manipulating handle 130 to the open position (FIG. 8B). Left hand 232 then removes stop 74 from stop slit 78 (FIG. 8C), before grasping long gun 30 near butt 38 (FIG. 8D). At this point, right hand 230 releases leash 50 (FIG. 8E), while left hand 232 rotates long gun 30 away from grasping mechanism 92 (also depicted in FIG. 8E). Left hand 232 continues to rotate long gun 30 (FIG. 8F) to a point where right hand 230 grasps forend 34 of long gun 30 (FIG. 8G), at which point left hand 232 is repositioned to a grip 36 of long gun 30 (also depicted in FIG. 8G). Long gun 30 is now fully accessed.

Figure 8H:
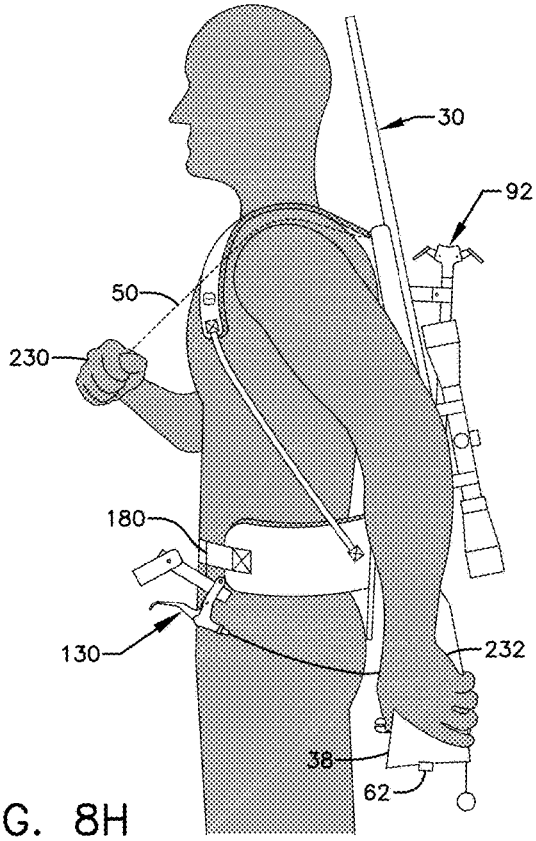

Prior to securing long gun 30 to long gun mounting device 10, the user ensures that the chamber of long gun 30 is empty. Once made safe, the preferred process by which long gun 30 is secured begins with left hand 232 placing butt 38 of long gun 30 onto horizontal surface 62 of first member 60 (FIG. 8H). Following this, right hand 230, grasping second leash end 54, guides forend 34 of long gun 30 towards grasping mechanism 92 (also depicted in FIG. 8H). Once forend 34 has been replaced in between grasping arms 94 and 96 (FIG. 8D), stop 74 is replaced in stop slit 78 (FIG. 8C), handle 130 is manipulated to the closed position (FIG. 8B), and second leash end 54 is secured to adjacent shoulder strap 24 (not shown). Long gun 30 is now secured to long gun mounting device 10, and by extension to backpack 20.

The preferred procedure described above for removing and securing long gun 30, as well as all of the drawing figures, are representative of long gun 30 being placed on the left hand side of backpack 20, and is generally intended for a left handed user. In the event that long gun 30 is to be placed on the right hand side of backpack 20, for a right handed user, the various actions described above for right hand 230 and left hand 232 would be reversed.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A mounting device attachable on a backpack or the like, said mounting device comprising:

a generally rigid first member having a horizontal surface for receiving a butt of a long gun and a securing means for securing said butt to said first member;

a second member for receiving a barrel or barrel and forend of said long gun, said second member being defined by a grasping mechanism wherein said grasping mechanism is remotely manipulated from a location near said first member, or from a waist belt or a shoulder strap of said backpack; and, said first and second members being fastened to opposite ends of a generally rigid base member.

2. The mounting device as defined in claim 1 wherein said first member securing means includes an elastic member, wherein a first end of said elastic member is fastened to a first end of a horizontal member, and a second end of said elastic member engages a retaining means with a second end of said horizontal member for quick connect/disconnect therewith.

3. The mounting device as defined in claim 2 wherein said retaining means includes a stop fastened to said second end of said elastic member, wherein said stop engages a stop slit in said second end of said horizontal member.

4. The mounting device as defined in claim 1 wherein the distance between said horizontal surface of said first member is adjustable relative to said second member.

5. The mounting device as defined in claim 1 wherein said first member is pivotally attached to said base member.

6. The mounting device as defined in claim 1 wherein remote manipulation of said grasping mechanism is conducted by way of a grasping mechanism control handle.

7. The mounting device as defined in claim 6 wherein said grasping mechanism control handle is defined in part by a bicycle brake handle.

8. The mounting device as defined in claim 6 or 7 wherein said grasping mechanism control handle further comprises a releasable locking device.

9. The mounting device as defined in claim 1 wherein said grasping mechanism is manipulated by a remote wireless controller.

10. The mounting device as defined in claim 1 wherein an opening adjustment plate is pivotally attached to said grasping mechanism.

11. The mounting device as defined in claim 1 wherein said first member securing means includes a grasping mechanism, said grasping mechanism of said first member being coordinated in operation with said grasping mechanism of said second member.

12. The mounting device as defined in claim 1 wherein a coupling means attaches said mounting device to said backpack and form a stable long gun mounting platform.

13. A mounting device attachable on a backpack or the like, said mounting device comprising:

a generally rigid and elongated base member;

a generally rigid first member pivotally attached to a first end of said base member, wherein said first member includes a horizontal surface for receiving a long gun butt, and wherein said horizontal surface is adjustable in a direction that is parallel to the longitudinal axis of said base member;

a securing means for securing said long gun butt to said first member, wherein said securing means includes an elastic member;

a second member attached to a second end of said base member, wherein said second member includes a grasping means for grasping a long gun barrel or barrel and forend, and wherein said grasping means is controlled by a grasping mechanism control handle conveniently located near said first member, or on a front side of a user of said backpack when said backpack is worn; and, a coupling means for attaching said mounting device to said backpack and form a long gun accessible transportation system on the back of said backpack user.

14. The mounting device as defined in claim 13 wherein a first end of said elastic member is fastened to a first end of a horizontal member and a stop is fastened to a second end of said elastic member, wherein said stop engages a stop slit in a second end of said horizontal member for quick connect/disconnect therewith.

15. The mounting device as defined in claim 13 wherein said grasping mechanism control handle further comprises a releasable locking device.

16. The mounting device as defined in claim 13 wherein said grasping means includes an opening adjustment plate for accommodating various long gun sizes.

17. A method of securing said long gun to said mounting device as defined in claim 13 comprising:

placing said long gun butt on said horizontal surface of said first member;

guiding said long gun barrel or barrel and forend into said grasping means;

securing said long gun butt to said first member with said elastic member; and, manipulating said grasping mechanism control handle to secure said long gun barrel or barrel and forend in said grasping means.

18. A method of removing said long gun from said mounting device as defined in claim 13 comprising:

manipulating said grasping mechanism control handle to release said long gun barrel or barrel and forend from said grasping means;

releasing said elastic member securing said long gun butt to said first member;

rotating said long gun barrel or barrel and forend away from said grasping means; and, removing said long gun butt from said horizontal surface of said first member.

19. A combination comprising:

a backpack having a waist belt and at least one shoulder strap; and, a long gun mounting device comprising:

a generally rigid and elongated base member;

a generally rigid first member pivotally attached to a first end of said base member, wherein said first member includes a horizontal surface for receiving a long gun butt, and wherein said horizontal surface is adjustable in a direction that is parallel to the longitudinal axis of said base member;

a securing means for securing said long gun butt to said first member, wherein said securing means includes an elastic member;

a second member attached to a second end of said base member, wherein said second member includes a grasping means for grasping a long gun barrel or barrel and forend, and wherein said grasping means is manipulated with the use of a grasping mechanism control handle positioned near said first member, or affixed to said waist belt or said shoulder strap of said backpack; a leash attached to said long gun; and a coupling means for attaching said mounting device to said pack.

* * * * *